US011560882B2

(12) United States Patent
Shi et al.

(10) Patent No.: US 11,560,882 B2
(45) Date of Patent: Jan. 24, 2023

(54) PLUNGER PUMP TAPPET ASSEMBLY AND ROLLER THEREOF

(71) Applicant: Robert Bosch GmbH, Stuttgart (DE)

(72) Inventors: Kai Shi, Jiangsu (CN); Wei Zhang, Jiangsu (CN)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/394,569

(22) Filed: Aug. 5, 2021

(65) Prior Publication Data

US 2022/0065235 A1 Mar. 3, 2022

(30) Foreign Application Priority Data

Sep. 2, 2020 (CN) ..... 202021886871.5

(51) Int. Cl.
*F04B 1/0426* (2020.01)

(52) U.S. Cl.
CPC ..... *F04B 1/0426* (2013.01)

(58) Field of Classification Search
CPC ..... F04B 1/0426; F04B 1/0413; F04B 9/042; F02M 59/102
USPC ..... 74/55, 567; 92/129
See application file for complete search history.

(56) References Cited

U.S. PATENT DOCUMENTS 6,390,685 B1 * 5/2002 Shimomura ..... F16C 19/26 384/450
7,311,087 B2 * 12/2007 Shaull ..... F02M 59/102 123/495
7,878,169 B2 * 2/2011 Brinks ..... F02M 59/44 123/90.55
2010/0138020 A1 * 6/2010 Gustafsson ..... F01L 1/26 703/2
2011/0052427 A1 * 3/2011 Shaull ..... F02M 59/102 417/364
2015/0198229 A1 * 7/2015 Unes ..... F02M 63/0001 74/569
2015/0211454 A1 * 7/2015 Tanabe ..... F04B 17/05 417/364
2015/0275834 A1 * 10/2015 Crofts ..... F01L 1/146 92/129
2016/0201630 A1 * 7/2016 Smith ..... F16H 53/06 476/67
2016/0215663 A1 * 7/2016 Kuroda ..... F01M 1/02
2016/0222934 A1 * 8/2016 Oki ..... F02M 59/025
2017/0074253 A1 * 3/2017 Conti ..... F04B 17/05
2017/0107863 A1 * 4/2017 Di Nunno ..... F02M 59/102
2019/0024773 A1 * 1/2019 Rabin ..... F01L 1/14
2020/0284230 A1 * 9/2020 Takamizawa ..... F01L 1/14

* cited by examiner

*Primary Examiner* — Kenneth J Hansen
*Assistant Examiner* — Benjamin Doyle
(74) *Attorney, Agent, or Firm* — Maginot, Moore & Beck LLP

(57) ABSTRACT

A plunger pump includes a plunger pump tappet assembly and a roller. The roller includes a revolving body configured to revolve along a central axis. The revolving body includes logarithmic parts and a straight part which are integrally formed. The logarithmic parts are symmetrically provided at two ends of the straight part in an axial direction of the central axis. In a cross section of the revolving body along and through the central axis, an outline of the straight part forms a straight line, and an outline of the logarithmic part forms a logarithmic curve, with an X-axis lying along the central axis, and a perpendicular bisector of the X-axis as a Y-axis.

5 Claims, 2 Drawing Sheets

PLUNGER PUMP TAPPET ASSEMBLY AND ROLLER THEREOF

This application claims priority under 35 U.S.C. § 119 to patent application no. CN 202021886871.5, filed on Sep. 2, 2020 in China, the disclosure of which is incorporated herein by reference in its entirety.

The disclosure relates to a revolving component of a plunger pump, in particular to a plunger pump tappet assembly and a roller thereof.

BACKGROUND

A plunger pump is a form of pump that is commonly used in the field of high-pressure pumps; it pressurizes a fluid through reciprocation of a plunger, thereby obtaining a high-pressure fluid. A cam mechanism is generally used to push the plunger to move. As shown in FIG. 1, a high-pressure plunger pump 9 comprises a housing 90, a high-pressure assembly disposed in a plunger chamber 91 in the housing 90, and a cam assembly disposed in a cam chamber 92 in the housing, with a tappet assembly between the high-pressure assembly and the cam assembly. The cam assembly has a cam 921, the tappet assembly has a cylindrical roller 931, and a plunger of the high-pressure assembly is provided above a tappet 932. During operation, the cam 921 rotates under the driving action of a camshaft, and the cam 921 pushes the roller 931 to reciprocate up and down in the plunger chamber 91, so that the plunger 94 also reciprocates up and down in the plunger chamber 91, thereby compressing the fluid.

However, an outer contour line, i.e. profile, of the conventional roller 931 has more than one form: one is a straight line, another is an arc, see FIG. 2. However, a profile in the prior art has a high failure rate in the process of coming into contact with the cam 921. The failure rate is higher with long-term operation at high pressure and high rotation speed.

SUMMARY

The object of the disclosure is to provide a plunger pump tappet assembly and a roller thereof, which can solve the problem in the prior art.

To achieve the abovementioned object of the application, the disclosure provides a roller for a tappet assembly of a plunger pump, characterized by comprising a revolving body that revolves along a central axis, the revolving body having logarithmic parts and a straight part which are integrally formed, the logarithmic parts being symmetrically provided at two ends of the straight part in an axial direction of the central axis; in a cross section of the revolving body along and through the central axis, an outline of the straight part forms a straight line, and an outline of the straight part and the logarithmic part forms a logarithmic curve, with an upper edge along the outline as an X axis, and a line perpendicular to the X axis and passing through an axial center of the roller as a Y axis.

The disclosure also has the following characteristic: the revolving body has a central hole.

The disclosure also has the following characteristic: the straight part accounts for 40-50% of the axial length of the revolving body along the central axis.

The disclosure also has the following characteristic: the logarithmic curve conforms to a function.

$$\begin{cases} y = 0 (x \le 5) \\ y = -0.008 \cdot \ln \dfrac{7}{7 - 2.3 \cdot \left[\dfrac{2(x-5)}{7}\right]^2} \quad (5 < x \le 10.4) \end{cases}$$

The disclosure further provides a tappet assembly, comprising a tappet and a roller disposed in a receiving slot of the tappet, the roller having the characteristics as described above.

The disclosure also has the following characteristic: the roller has a central hole, with a pin being provided in the central hole.

By using the technical solution provided in the disclosure, the failure rate of the tappet assembly can be effectively reduced.

BRIEF DESCRIPTION OF THE DRAWINGS

Exemplary embodiments of the disclosure are explained in detail below with reference to the drawings. It should be understood that the embodiments described below are merely intended to explain the disclosure, without limiting the scope thereof. In the attached drawings.

DETAILED DESCRIPTION

It should be understood that the drawings are merely intended to illustrate the disclosure in an exemplary fashion. The longitudinal axis of each device in the disclosure is understood to be the axis in the direction in which the body of the device is longer.

Figure 1:
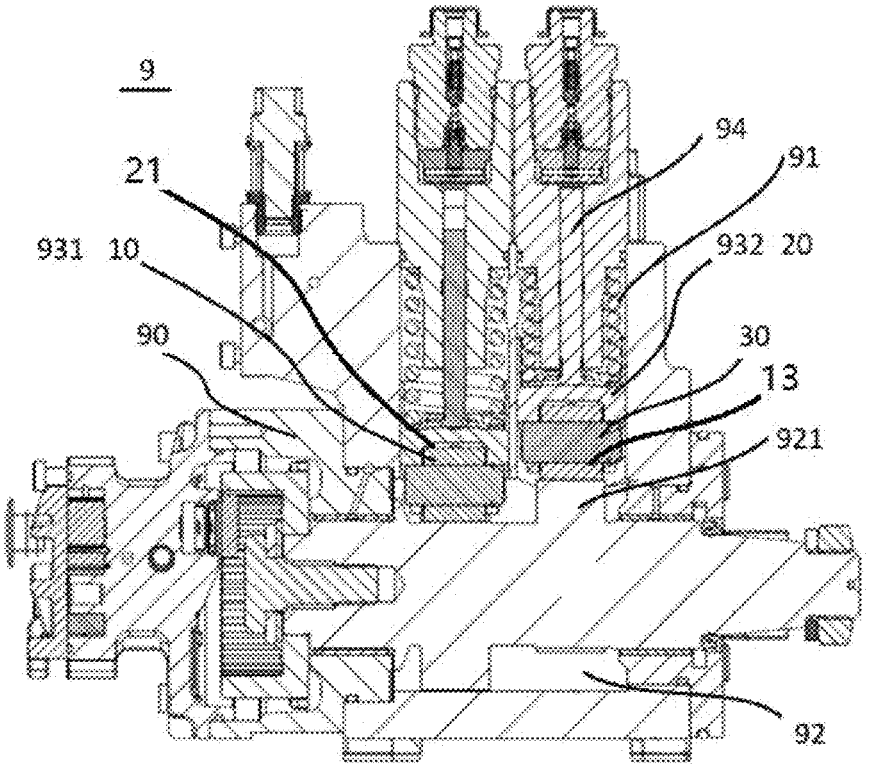
FIG. 1 is a schematic structural drawing of a high-pressure plunger pump, showing the position of the tappet assembly in the high-pressure plunger pump.
Figure 2:
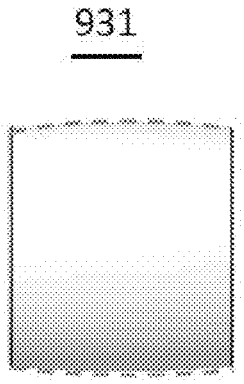
FIG. 2 is a schematic drawing of a tappet assembly roller in the prior art, in which a dotted line is used to show an outline of the roller in an exaggerated fashion.
Figure 3:
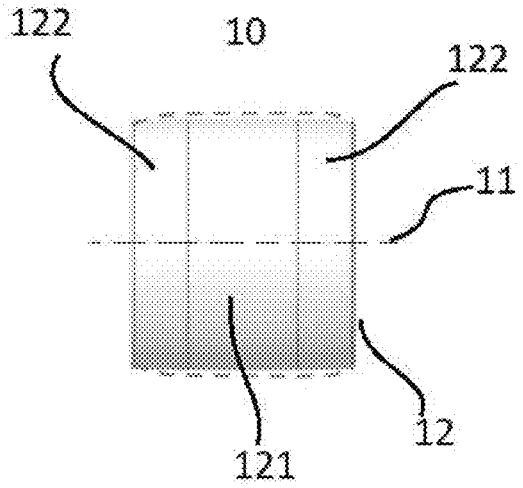
FIG. 3 is a schematic drawing of a tappet assembly roller in the disclosure, in which a dotted line is shown in an exaggerated fashion to show an outline of the roller.

Referring to FIGS. 1, 2 and 3, FIG. 1 is a schematic structural drawing of a high-pressure plunger pump; since the main difference between the disclosure and the prior art is the difference between the rollers, FIG. 1 can be used to explain the structure of a tappet assembly of a plunger pump to which the disclosure is applicable. As shown in FIG. 1, the high-pressure plunger pump 9 comprises the housing 90, the high-pressure assembly disposed in the plunger chamber 91 in the housing 90, and the cam assembly disposed in the cam chamber 92 in the housing, with the tappet assembly between the high-pressure assembly and the cam assembly. The cam assembly has the cam 921, the tappet assembly has the substantially cylindrical roller 931, and the plunger of the high-pressure assembly is provided above the tappet 932. During operation, the cam 921 rotates under the driving action of the camshaft, and the cam 921 pushes the roller 931 to reciprocate up and down in the plunger chamber 91, so that the plunger 94 also reciprocates up and down in the plunger chamber 91, thereby compressing the fluid.

Referring to FIGS. 1 and 3, the tappet assembly comprises a tappet 20, a roller 10 and a pin 30. The tappet 20 has a receiving slot 21, and the roller 10 is disposed in the receiving slot 21. The pin 30 is disposed in a central hole 13 of the roller 10, and the roller 10 rotates around the pin 30. The roller 10 comprises a revolving body 12, which revolves along a central axis 11 and is constructed substantially as a cylinder. The revolving body 12 has logarithmic parts 122 and a straight part 121 which are integrally formed; two logarithmic parts 122 are provided symmetrically at two ends of the straight part 121. The straight part 121 accounts for 40-50% of the axial length of the revolving body 12 along the central axis 11. In a cross section of the revolving body 12 along and through the central axis 11, a contour of the straight part 121 is a straight line, and an outline of the straight part 121 and the logarithmic part 122 forms a logarithmic curve, with an upper-edge straight line along the contour as an X axis, and a line perpendicular to the X axis and passing through an axial center of the roller 10 as a Y axis, wherein a function representing the logarithmic curve is preferably as follows.

$$\begin{cases} y = 0(x \le 5) \\ y = -0.008 \cdot \ln \dfrac{7}{7 - 2.3 \cdot \left[\dfrac{2(x-5)}{7}\right]^2} \quad (5 < x \le 10.4) \end{cases}$$

The disclosure can also have other embodiments, all of which are included within the scope of protection of the disclosure as long as the results thereof do not violate the inventive concept of the disclosure.

REFERENCE NUMBERS

Receiving slot 21
Central axis 11
Revolving body 12
Straight part 121
Logarithmic part 122
Central hole 13
Tappet 20
Pin 30
High-pressure plunger pump 9
Housing 90
Plunger chamber 91
Cam chamber 92
Cam 921
Roller 931
Tappet 932
Plunger 94

What is claimed is:

1. A roller for a tappet assembly of a plunger pump, comprising:

a revolving body configured to revolve along a central axis, the revolving body having logarithmic parts and a straight part integrally formed with the logarithmic parts, wherein the logarithmic parts are symmetrically located at two ends of the straight part in an axial direction of the central axis, wherein a cross section of the revolving body, along and through the central axis, defines an outline including (i) an outline portion of the straight part that forms a straight line, and (ii) another outline portion of the straight part and each logarithmic part that form logarithmic curves, wherein an upper edge along the outline defines an X-axis, and wherein a line perpendicular to the X-axis and passing through an axial center of the roller defines a Y-axis, wherein the logarithmic curves conform to the following function:

$$\begin{cases} y = 0(x \le 5) \\ y = -0.008 \cdot \ln \dfrac{7}{7 - 2.3 \cdot \left[\dfrac{2(x-5)}{7}\right]^2} \quad (5 < x \le 10.4). \end{cases}$$

2. The roller according to claim 1, wherein the revolving body defines a central hole.

3. The roller according to claim 1, wherein the straight part accounts for 40-50% of an axial length of the revolving body along the central axis.

4. A tappet assembly, comprising:

a tappet defining a receiving slot; and a roller disposed in the receiving slot, the roller including a revolving body configured to revolve along a central axis, the revolving body having logarithmic parts and a straight part integrally formed with the logarithmic parts, wherein the logarithmic parts are symmetrically located at two ends of the straight part in an axial direction of the central axis, wherein a cross section of the revolving body, along and through the central axis, defines an outline including (i) an outline portion of the straight part that forms a straight line, and (ii) another outline portion of the straight part and the logarithmic part that forms a logarithmic, wherein an upper edge along the outline defines an X-axis, and wherein a line perpendicular to the X-axis and passing through an axial center of the roller defines a Y-axis.

5. The tappet assembly according to claim 4, wherein:

the roller defines a central hole, and a pin is located in the central hole.

* * * * *